US009429880B2

(12) United States Patent
Yamaura

(10) Patent No.: US 9,429,880 B2
(45) Date of Patent: Aug. 30, 2016

(54) TRANSFER DEVICE AND IMAGE FORMING APPARATUS

(71) Applicant: FUJI XEROX CO., LTD., Tokyo (JP)

(72) Inventor: Masaaki Yamaura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/604,131

(22) Filed: Jan. 23, 2015

(65) Prior Publication Data

US 2016/0091839 A1 Mar. 31, 2016

(30) Foreign Application Priority Data

Sep. 26, 2014 (JP) ..... 2014-196064

(51) Int. Cl.
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/1665; G03G 15/1605; G03G 15/169
See application file for complete search history.

(56) References Cited

U.S. PATENT DOCUMENTS 4,701,042 A * 10/1987 Mimura ..... G03G 15/065 399/296
5,189,478 A * 2/1993 Hara ..... G03G 15/0131 399/296
8,781,348 B2 7/2014 Ogino et al.
8,923,716 B2 12/2014 Nakamura et al.
2004/0001730 A1* 1/2004 Shin ..... G03G 15/169 399/296
2005/0008379 A1* 1/2005 Omata ..... G03G 15/169 399/45
2008/0069590 A1* 3/2008 Shigehiro ..... G03G 21/0064 399/149

FOREIGN PATENT DOCUMENTS

JP 2012-042827 A 3/2012
JP 2012-063746 A 3/2012

* cited by examiner

*Primary Examiner* — Sandra Brase
(74) *Attorney, Agent, or Firm* — Oliff PLC

(57) ABSTRACT

An image forming apparatus includes at least one image carrier that carries a toner image, an intermediate transfer body that is rotatable and that faces the image carrier, an opposing member that is positioned upstream of a second transfer section in a rotation direction of the intermediate transfer body and that faces the intermediate transfer body, and a voltage application unit that applies an AC voltage, whose polarity reverses, and forms an AC electric field between the intermediate transfer body and the opposing member. A first transfer section in which the toner image on the image carrier is transferred onto a surface of the intermediate transfer body is formed. The second transfer section that is positioned downstream of the first transfer section in the direction of rotation of the intermediate transfer body and in which the toner image on the intermediate transfer body is transferred onto a medium is formed.

6 Claims, 7 Drawing Sheets

FIG. 4A

| | ELECTRIC-FIELD-GENERATING MEMBER | | | SECOND TRANSFER UNIT | | EMBOSS G | WHITE SPOT | TRANSFERABILITY ONTO JAPANESE PAPER | RESISTANCE-REDUCTION AMOUNT OF INTERMEDIATE TRANSFER BELT [log Ω] |
|---|---|---|---|---|---|---|---|---|---|
| | DC [kV] | AC [kV] | gap [μm] | DC [kV] | AC [kV] | | | | |
| EXAMPLE 1-1 | 0.6 | 3.6 | 200 | −4 | 0 | G2 | ○ | ○ | 0 |
| EXAMPLE 1-2 | 0.6 | 3.6 | 20 | −4 | 0 | G1 | ○ | ○ | 0 |
| EXAMPLE 1-3 | 0.6 | 3.6 | 10 | −4 | 0 | G5 | ○ | × | 0 |
| EXAMPLE 1-4 | 0.6 | 3.6 | 250 | −4 | 0 | G5.5 | ○ | × | 0 |
| COMPARATIVE EXAMPLE 1 | 0 | 0 | 0 | −4 | 0 | G6 | ○ | × | 0 |
| COMPARATIVE EXAMPLE 2 | 0 | 0 | 0 | −1.6 | 9.6 | G2 | × | × | 1.5 |
| COMPARATIVE EXAMPLE 3 | 0 | 0 | 0 | −1.6 | 6.0 | G4 | △ | × | 0.5 |

WHITE SPOT
○ : NOT GENERATED
△ : SOMEWHAT GENERATED
× : GENERATED

TRANSFERABILITY ONTO JAPANESE PAPER
○ : PK300% PATCH, Y COLOR DENSITY IS 1.8 OR HIGHER
× : PK300% PATCH, Y COLOR DENSITY IS LOWER THAN 1.8

FIG. 4B

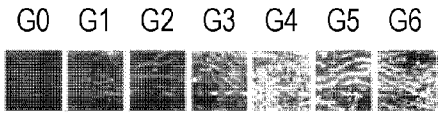

TRANSFER DEVICE AND IMAGE FORMING APPARATUS

CROSS-REFERENCE TO RELATED APPLICATIONS

This application is based on and claims priority under 35 USC 119 from Japanese Patent Application No. 2014-196064 filed Sep. 26, 2014.

BACKGROUND

Technical Field

The present invention relates to a transfer device and an image forming apparatus.

SUMMARY

According to an aspect of the invention, there is provided an image forming apparatus including at least one image carrier that carries a toner image, an intermediate transfer body that is rotatable and that faces the image carrier, an opposing member that is positioned upstream of a second transfer section in a direction of rotation of the intermediate transfer body and that faces the intermediate transfer body, and a voltage application unit that applies an alternating-current voltage, whose polarity reverses, and forms an alternating-current electric field between the intermediate transfer body and the opposing member. A first transfer section in which the toner image on the image carrier is transferred onto a surface of the intermediate transfer body is formed, and the second transfer section that is positioned downstream of the first transfer section in the direction of rotation of the intermediate transfer body and in which the toner image on the intermediate transfer body is transferred onto a medium is formed.

BRIEF DESCRIPTION OF THE DRAWINGS

Exemplary embodiments of the present invention will be described in detail based on the following figures, wherein:

FIGS. 4A and 4B are respectively a table and a diagram illustrating Examples 1-1 to 1-4 and Comparative Examples 1 to 3, FIG. 4A showing experimental conditions and experimental results, and FIG. 4B showing a criterion for evaluation of emboss grade (G);

DETAILED DESCRIPTION

Figure 1:
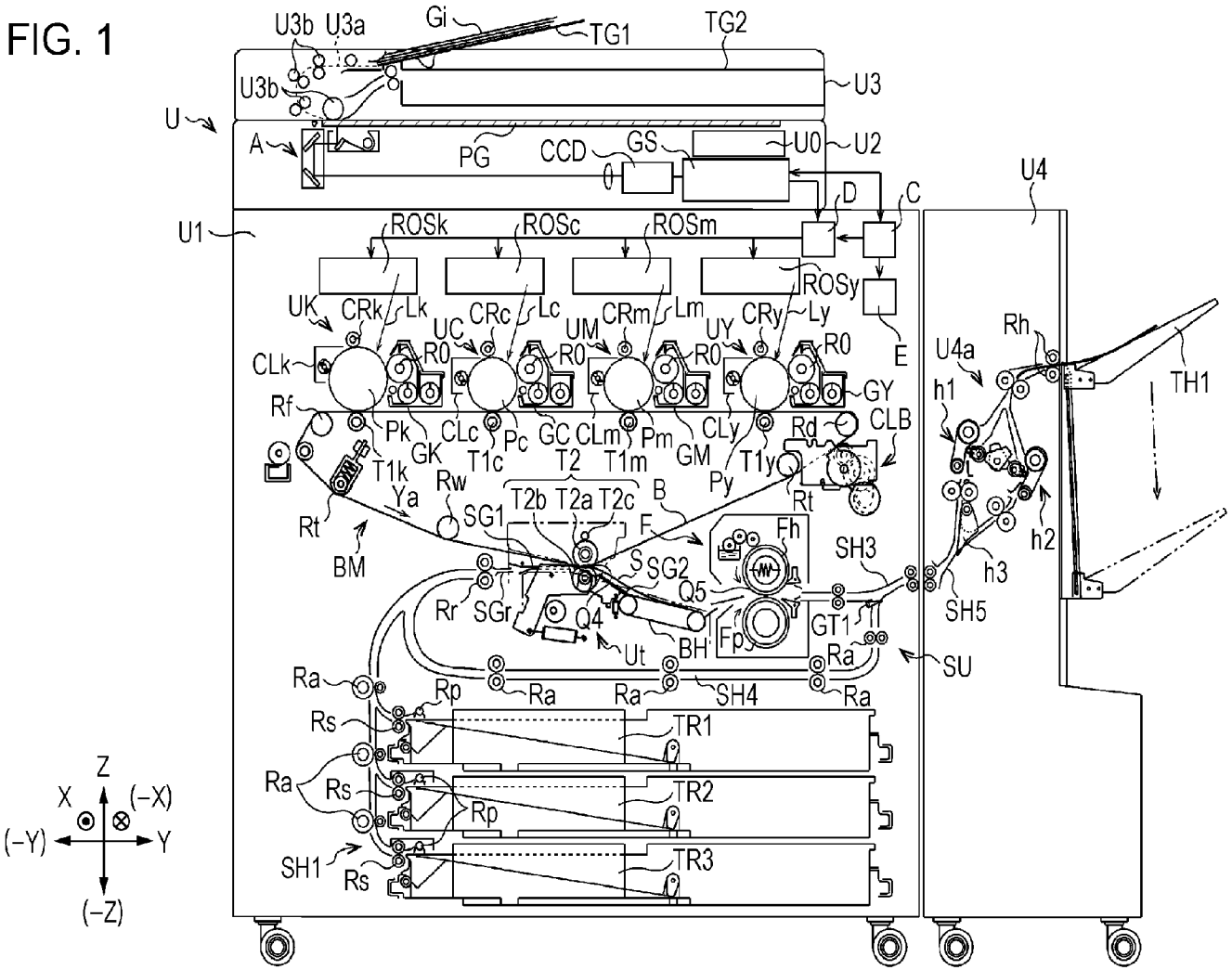
FIG. 1 is a diagram illustrating an image forming apparatus of a first exemplary embodiment.

Specific exemplary embodiments of the present invention (hereinafter referred to as a first exemplary embodiment and a second exemplary embodiment) will now be described with reference to the drawings. However, the present invention is not limited to the following exemplary embodiments.

For ease of understanding of the following description, in the drawings, a front-rear direction, a left-right direction, and a top-bottom direction are respectively defined as the x-axis direction, the y-axis direction, and the z-axis direction, and directions or sides indicated by arrows X, −X, Y, −Y, Z, and −Z are respectively defined as a forward direction, a backward direction, a right direction, a left direction, an upward direction, and a downward direction or the front side, the rear side, the right side, the left side, the top side, and the bottom side.

In addition, a symbol having "•" in "○" denotes an arrow extending from the distal side to the proximal side as viewed in the drawings, and a symbol having "×" in "○" denotes an arrow extending from the proximal side to the distal side as viewed in the drawings.

Note that, in the following description, which refers to the drawings, descriptions of components that are not necessarily illustrated are omitted for ease of understanding of the following description.

[First Exemplary Embodiment]

FIG. 1 is a diagram illustrating an image forming apparatus of the first exemplary embodiment.

In FIG. 1, a copying machine U, which is an example of the image forming apparatus of the first exemplary embodiment, includes a printer unit U1, which is an example of a body of an image forming apparatus and an example of an image recording device. A scanner unit U2, which is an example of a reading unit and an example of an image reading device, is supported on the printer unit U1. An autofeeder U3, which is an example of a document transport device, is supported on the scanner unit U2. A user interface U0, which is an example of an input unit, is supported in the scanner unit U2 of the first exemplary embodiment. An operator may operate the copying machine U by performing an input operation by using the user interface U0.

A subsequent processing device U4 is disposed on the right side of the printer unit U1.

A document tray TG1, which is an example of a medium container, is disposed on the autofeeder U3. Multiple documents Gi that are to be subjected to a copying operation may be stacked and accommodated in the document tray TG1. A document ejection tray TG2, which is an example of a document ejection unit, is formed below the document tray TG1. Document transport rollers U3*b* are disposed along a document transport path U3*a* between the document tray TG1 and the document ejection tray TG2.

A platen glass PG, which is an example of a transparent document table, is disposed on a top surface of the scanner unit U2. In the scanner unit U2 of the first exemplary embodiment, a reading optical system A is disposed below the platen glass PG. The reading optical system A of the first exemplary embodiment is supported in such a manner as to be movable in the left-right direction along a bottom surface of the platen glass PG. Note that the reading optical system A is normally stationary at an initial position illustrated in FIG. 1.

An imaging device CCD, which is an example of an imaging member, is disposed on the right side of the reading optical system A. An image processing unit GS is electrically connected to the imaging device CCD.

The image processing unit GS is electrically connected to a controller C and a write circuit D of the printer unit U1. The write circuit D is electrically connected to exposure devices ROSy, ROSm, ROSc, and ROSk corresponding to colors yellow (Y), magenta (M), cyan (C), and black (K).

In FIG. 1, photoconductor drums Py, Pm, Pc, and Pk, each of which is an example of an image carrier, are disposed below the exposure devices ROSy to ROSk, respectively.

A charger CRk, a developing device GK, a first transfer roller T1*k*, which is an example of a first transfer unit, and a drum cleaner CLk, which is an example of an image-carrier-cleaning unit, are disposed around the periphery of the photoconductor drum Pk corresponding to color K along the direction of rotation of the photoconductor drum Pk.

A charged voltage that is used for charging the photoconductor drum Pk is applied to the charger CRk from a power supply circuit E. The developing device GK includes a developing roller R0, which is an example of a developer carrier. A developing voltage is applied to the developing roller R0 from the power supply circuit E. A first transfer voltage having a polarity opposite to the charge polarity of a developer is applied to the first transfer roller T1*k* from the power supply circuit E.

In the first exemplary embodiment, the photoconductor drum Pk, the charger CRk, and the drum cleaner CLk are integrated with one another as to form an image carrier unit UK. The image carrier unit UK is supported on the printer unit U1 in such a manner as to be removable from the printer unit U1. Image carrier units UY, UM, and UC, each of which has a configuration similar to that of the image carrier unit UK for color K, are formed for colors Y, M, and C. Accordingly, the image carrier unit UY includes a photoconductor drum Py, a charger CRy, and a drum cleaner CLy. The image carrier unit UM includes a photoconductor drum Pm, a charger CRm, and a drum cleaner CLm. The image carrier unit UC includes a photoconductor drum Pc, a charger CRc, and a drum cleaner CLc.

In the first exemplary embodiment, each of developing devices GY to GK is formed as a unit and is supported in such a manner as to be removable from the printer unit U1.

The image carrier unit UY and the developing device GY form a toner-image-forming member UY+GY. The image carrier unit UM and the developing device GM form a toner-image-forming member UM+GM. The image carrier unit UC and the developing device GC form a toner-image-forming member UC+GC. The image carrier unit UK and the developing device GK form a toner-image-forming member UK+GK.

A belt module BM, which is an example of an intermediate transfer device, is disposed below the image carrier units UY to UK. The belt module BM includes an intermediate transfer belt B, which is an example of an intermediate transfer body, belt support rollers Rd, Rt, Rw, Rf, and T2*a*, each of which is an example of a support member that supports an intermediate transfer body, and first transfer rollers T1*y*, T1*m*, T1*c*, and T1*k*. The belt support rollers Rd, Rt, Rw, Rf, and T2*a* includes the belt-driving roller Rd, which is an example of a driving member, the tension rollers Rt, each of which is an example of a tension-applying member, the working roller Rw, which is an example of a member that prevents a belt from moving in a serpentine manner, the idle roller Rf, which is an example of a driven member, and the backup roller T2*a*, which is an example of an opposing member for use in a second transfer process.

The intermediate transfer belt B is supported by the belt support rollers Rd, Rt, Rw, Rf, and T2*a* in such a manner as to be capable of performing a rotational movement in the direction of arrow Ya.

A second transfer unit Ut is disposed below the backup roller T2*a*. The second transfer unit Ut includes a second transfer roller T2*b*, which is an example of a second transfer member. The second transfer roller T2*b* is supported in such a manner as to be capable of making contact with or separating from the backup roller T2*a* with the intermediate transfer belt B interposed therebetween. An area in which the second transfer roller T2*b* makes contact with the intermediate transfer belt B forms a second transfer region Q4, which is an example of an image recording region. A contact roller T2*c*, which is an example of a contact member for use in application of a voltage is in contact with the backup roller T2*a*. A second transfer voltage having a polarity that is the same as the charge polarities of toners is applied to the contact roller T2*c* from the power supply circuit E at a predetermined timing. The rollers T2*a* to T2*c* form a second transfer unit T2.

A belt cleaner CLB, which is an example of a cleaning unit configured to clean an intermediate transfer body, is disposed downstream of the second transfer region Q4 in the direction of rotation of the intermediate transfer belt B.

The first transfer rollers T1*y* to T1*k*, the intermediate transfer belt B, the second transfer unit T2, the belt cleaner CLB, and the like form a transfer device T1+B+T2+CLB that transfers toner images on surfaces of the photoconductor drums Py to Pk onto one of sheets S.

Sheet feed trays TR1 to TR3, each of which is an example of a medium accommodating unit, are supported in a lower portion of the printer unit U1 in such a manner as to be removable from the printer unit U1. The sheets S, each of which is an example of a medium, are accommodated in the sheet feed trays TR1 to TR3.

Pick-up rollers Rp, each of which is an example of a member that takes out a medium, are disposed on the upper left sides of the sheet feed trays TR1 to TR3. Pairs of separation rollers Rs, each of which is an example of a separation member, are disposed on the left sides of the pick-up rollers Rp.

A transport path SH1 that extends upward and along which a medium is to be transported is formed on the left side of the sheet feed trays TR1 to TR3. Multiple transport rollers Ra, each of which is an example of a medium transport member, are disposed on the transport path SH1.

Registration rollers Rr, each of which is an example of a delivery member, are disposed on the transport path SH1 and positioned downstream in a direction in which the sheets S are to be transported (hereinafter referred to as "sheet S transport direction") and upstream of the second transfer region Q4 in the sheet S transport direction.

A registration guide SGr and a pre-transfer sheet guide SG1, each of which is an example of a medium guiding member, are disposed in this order further downstream than the registration rollers Rr in the sheet S transport direction.

A post-transfer sheet guide SG2, which is an example of a medium guiding member, is disposed further downstream than the second transfer region Q4 in the sheet S transport direction. A transport belt BH, which is an example of a medium transport member, is disposed further downstream than the post-transfer sheet guide SG2 in the sheet S transport direction.

A fixing device F is disposed further downstream than the transport belt BH in the sheet S transport direction. The fixing device F includes a heating roller Fh, which is an example of a heating and fixing member, and a pressure roller Fp, which is an example of a pressing and fixing member. An area in which the heating roller Fh and the pressure roller Fp make contact with each other forms a fixing region Q5.

An ejection path SH3, which is an example of a medium transport path, is formed downstream of the fixing device F in the sheet S transport direction. The ejection path SH3 extends to the right side toward the subsequent processing device U4.

An upstream end of a reverse path SH4, which is an example of a medium transport path, is connected to a downstream end of the ejection path SH3. The reverse path SH4 of the first exemplary embodiment extends through an area below the second transfer unit Ut and above the sheet feed tray TR1, which is the uppermost sheet feed tray, and joins to the transport path SH1 at a position upstream of the registration rollers Rr in the sheet S transport direction. A first gate GT1, which is an example of a transport-path-switching member, is disposed at a branch at which the ejection path SH3 and the reverse path SH4 branch.

A processing path SH5, which is an example of a medium transport path, is formed in the subsequent processing device U4. A decurler U4*a*, which is an example of a curvature correction device, is disposed on the processing path SH5. The decurler U4*a* of the first exemplary embodiment includes a first curl correction member h1 and a second curl correction member h2, each of which is an example of a curvature correction member.

Ejection rollers Rh, each of which is an example of an ejection member, are disposed downstream of the decurler U4*a* in the sheet S transport direction. An ejection tray TH1, which is an example of an ejecting section, is disposed downstream of the ejection rollers Rh in the sheet S transport direction. The ejection tray TH1 of the first exemplary embodiment is supported in such a manner as to be movable in the top-bottom direction in accordance with the number of the sheets S stacked thereon.

The above-described components that are denoted by the reference numerals SH1 to SH5 form a medium transport path SH of the first exemplary embodiment. The above-described components that are denoted by the reference numerals SH, Ra, Rr, Rh, SGr, SG1, SG2, BH, GT1, and the like form a medium transport system SU.

(Description of Image Forming Operation)

In FIG. 1, in the copying machine U of the first exemplary embodiment, once a copy start key has been input via the user interface U0, the scanner unit U2 reads documents Gi.

In the case of performing a copying operation by automatically transporting the documents Gi by using the auto-feeder U3, the reading optical system A exposes the documents Gi, which sequentially pass through a document reading position on the platen glass PG, to light while being stationary at the initial position. Thus, the multiple documents Gi, which are accommodated in the document tray TG1, sequentially pass through the document reading position on the platen glass PG and are ejected to the document ejection tray TG2.

In the case where an operator performs a copying operation on the documents Gi by placing the documents Gi on the platen glass PG by their hands, the reading optical system A exposes to light and scans the documents Gi on the platen glass PG by moving in the left-right direction.

Light beams that have been reflected by the documents Gi are converged to the imaging device CCD through the reading optical system A. The imaging device CCD converts the light beams, which have been reflected by the documents Gi and have been converged to an imaging surface of the imaging device CCD, into electrical signals.

The image processing unit GS converts the electrical signals, which are input from the imaging device CCD, into digital image signals and outputs the digital image signals to the write circuit D of the printer unit U1. The write circuit D outputs laser-driving signals that correspond to image information items of yellow (Y), magenta (M), cyan (C), and black (K), which are input from the image processing unit GS, to the exposure devices ROSy, ROSm, ROSc, and ROSk for the corresponding colors, each of which is an example of a writing device, at a predetermined timing.

The controller C outputs signals that control the timing at which the write circuit D outputs signals and that control the power supply circuit E and the like.

Surfaces of the photoconductor drums Py to Pk are charged by the chargers CRy to CRk, respectively. Electrostatic latent images are formed on the surfaces of the photoconductor drums Py to Pk, which have been charged, by laser beams Ly, Lm, Lc, and Lk, each of which is an example of a writing light beam and each of which is output from a corresponding one of the exposure devices ROSy to ROSk. The electrostatic latent images on the surfaces of the photoconductor drums Py to Pk are developed into toner images of yellow (Y), magenta (M), cyan (C), and black (K), each of which is an example of a visible image, by the developing devices GY to GK.

The toner images on the surfaces of the photoconductor drums Py to Pk are transferred in a first transfer process onto the intermediate transfer belt B by the first transfer rollers T1*y* to T1*k*. In the case of forming a polychromatic image, or specifically a color image, toner images on the photoconductor drums Py to Pk are sequentially transferred onto the intermediate transfer belt B in such a manner as to be superposed with one another. In the case of forming only black image data, only the photoconductor drum Pk and the developing device GK for color K are used, and only a black toner image is formed. Accordingly, only the black toner image is transferred onto the intermediate transfer belt B.

After the first transfer process has been performed, the drum cleaners CLy to CLk clean toners that remain on the surfaces of the corresponding photoconductor drums Py to Pk.

The toner images, which have been transferred to the intermediate transfer belt B, are transported to the second transfer region Q4.

One of the sheets S in one of the trays TR1 to TR3 is taken out by a corresponding one of the pick-up rollers Rp at a predetermined sheet feed timing. In the case where the multiple sheets S have been taken out while being stacked on top of one another by one of the pick-up rollers Rp, the corresponding pair of separation rollers Rs separate the sheets S one by one. One of the sheets S that has passed through one of the pairs of separation rollers Rs is transported to a position where the registration rollers Rr are disposed by at least one of the multiple transport rollers Ra.

The registration rollers Rr send out the sheet S in accordance with the timing at which the toner images are transported to the second transfer region Q4. The sheet S, which has been sent out by the registration rollers Rr, is guided by the guides SGr and SG1 in such a manner as to be transported to the second transfer region Q4.

When the toner images on the intermediate transfer belt B pass through the second transfer region Q4, the toner images are transferred onto the sheet S by the second transfer unit T2. Note that, in the case of a color image, the toner images that have been transferred in a first transfer process to a surface of the intermediate transfer belt B in such a manner as to be superposed with one another are collectively transferred in a second transfer process onto the sheet S.

After the intermediate transfer belt B has passed through the second transfer region Q4, residual toner on the intermediate transfer belt B is removed by the belt cleaner CLB.

The sheet S, to which the toner images have been transferred in the second transfer process, is transported to the fixing device F through the post-transfer sheet guide SG2 and the transport belt BH, which is an example of a pre-fixing medium transport member. The toner images on a surface of the sheet S are heated and fixed onto the sheet S by the fixing device F when passing through the fixing region Q5. The sheet S, to which the toner images have been heated and fixed in the fixing region Q5, is transported along the ejection path SH3.

In the case where the sheet S is to be ejected to the ejection tray TH1, the sheet S, which has been transported along the ejection path SH3, is transported to the processing path SH5 of the subsequent processing device U4. A switching gate h3 switches the sheet S destination to the first curl correction member h1 or the second curl correction member h2 in accordance with curvature direction, or specifically the curl, of the sheet S, which has been transported to the processing path SH5. Each of the curl correction members h1 and h2 corrects the curl of the sheet S that passes therethrough. The sheet S whose curl has been corrected is ejected to the ejection tray TH1 by the ejection rollers Rh.

In the case of performing two-sided printing on the sheet S, after a rear end of the sheet S has passed through the first gate GT1, the first gate GT1 switches the sheet S destination to the reverse path SH4. Then, transport rollers Ra that are disposed at the downstream end of the ejection path SH3 and transport rollers Ra that are disposed on the processing path SH5 rotate in a reverse direction. As a result, in a state where the sheet S transport direction is reversed by the transport rollers Ra, the sheet S, which has passed through the first gate GT1, is transported to the reverse path SH4. In other words, the sheet S is switched back. The sheet S, which has been switched back, is transported along the reverse path SH4 and transported to the position where the registration rollers Rr are disposed with the front and rear surfaces of the sheet S reversed.

(Description of Transfer Device of First Exemplary Embodiment)

Figure 2:
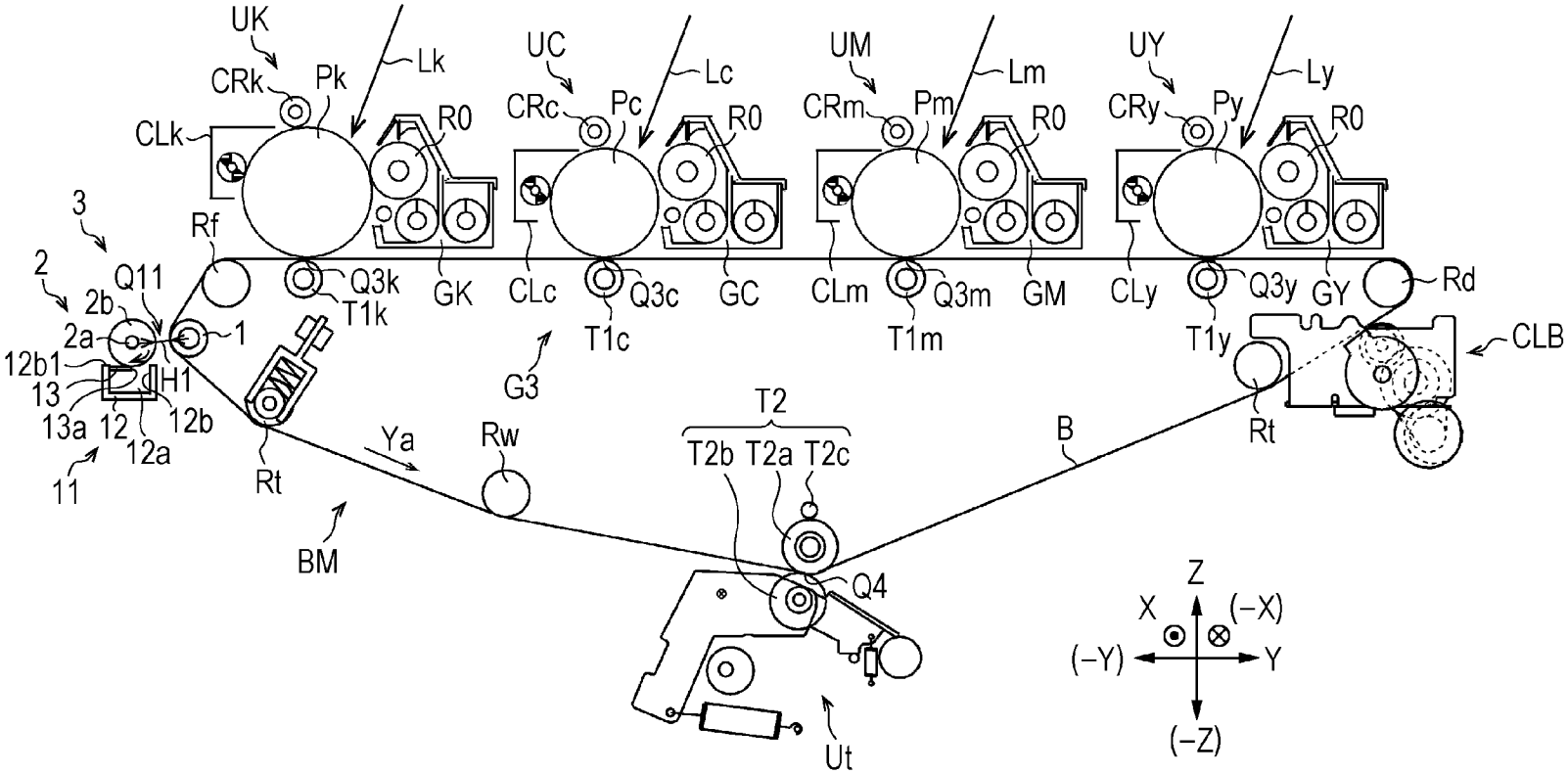
FIG. 2 is a diagram illustrating a transfer device of the first exemplary embodiment.

FIG. 2 is a diagram illustrating a transfer device of the first exemplary embodiment.

In FIGS. 1 and 2, the belt module BM of the first exemplary embodiment is an example of an electric-field-generating member and includes a support roller 1, which is an example of a member that supports an intermediate transfer body. The support roller 1 is rotatably supported on a frame body (not illustrated) of the belt module BM. In the rotation direction of the intermediate transfer belt B, the support roller 1 is disposed at a position downstream of the first transfer roller T1*k*, which is located on the most downstream side in the rotation direction of the intermediate transfer belt B, and upstream of the backup roller T2*a* of the second transfer unit T2. In the first exemplary embodiment, the support roller 1 is disposed at a position between the idle roller Rf, which is positioned further downstream than the first transfer roller T1*k*, which is located on the most downstream side, and one of the tension rollers Rt, which is positioned further upstream than the backup roller T2*a*. The support roller 1 is in contact with an inner surface of the intermediate transfer belt B. In the first exemplary embodiment, the support roller 1 has a configuration similar to those of the first transfer rollers T1*y* to T1*k*, each of which is an example of a first transfer member.

An opposing roller 2, which is an example of an electric-field-generating member and an example of an opposing member, is disposed at a position facing the support roller 1 with the intermediate transfer belt B interposed therebetween. The opposing roller 2 is arranged in such a manner that a gap H1 is formed between the opposing roller 2 and an outer surface of the intermediate transfer belt B. The opposing roller 2 includes a shaft 2*a* that extends in the front-rear direction. In addition, the opposing roller 2 includes a roller body 2*b* that has a cylindrical shape and that is supported by the shaft 2*a*. The length of the roller body 2*b* in the axial direction of the roller body 2*b* is set to be larger than a region in the intermediate transfer belt B on which toner images are to be held. An area in which the opposing roller 2 faces a portion of the intermediate transfer belt B with which the support roller 1 is in contact, that is, the area of the gap H1 forms a gap region Q11 of the first exemplary embodiment. In the opposing roller 2 of the first exemplary embodiment, the shaft 2*a* is rotatably supported. The opposing roller 2 of the first exemplary embodiment receives a driving force from a driving source (not illustrated) and rotates in the same direction as that in which the intermediate transfer belt B rotates in the gap region Q11.

The opposing roller 2 and the support roller 1 form an electric-field-generating member 3 of the first exemplary embodiment. Areas in each of which one of the photoconductor drums Py to Pk and the intermediate transfer belt B face each other form first transfer regions Q3*y*, Q3*m*, Q3*c*, and Q3*k*. A first transfer section Q3 of the first exemplary embodiment is formed of all of the the first transfer regions Q3*y*, Q3*m*, Q3*c*, and Q3*k*. Thus, the support roller 1 and the opposing roller 2 of the first exemplary embodiment are disposed downstream of the first transfer section Q3 and upstream of the second transfer region Q4, which is an example of a second transfer section, in the rotation direction of the intermediate transfer belt B.

An opposing cleaner 11, which is an example of a member that cleans an opposing member, is disposed downstream of the gap region Q11 in the direction of rotation of the opposing roller 2. The opposing cleaner 11 includes a case 12, which is an example of a support. The case 12 extends in the front-rear direction along the opposing roller 2. A containing space 12*a* in which a developer may be contained is formed in the case 12. An opening 12*b* that is open along the opposing roller 2 is formed in the case 12 on the side on which the opposing roller 2 is present. A blade 13, which is an example of a cleaning member, is supported at a downstream end 12*b*1 of the opening 12*b* in the rotation direction of the opposing roller 2. The blade 13 is formed in a shape of a plate that extends in the front-rear direction along the opposing roller 2. The blade 13 of the first exemplary embodiment extends from the downstream side toward the upstream side in the rotation direction of the opposing roller 2, and an end portion 13*a* of the blade 13 is in contact with a surface of the opposing roller 2 in a so-called counter direction.

Figure 3:
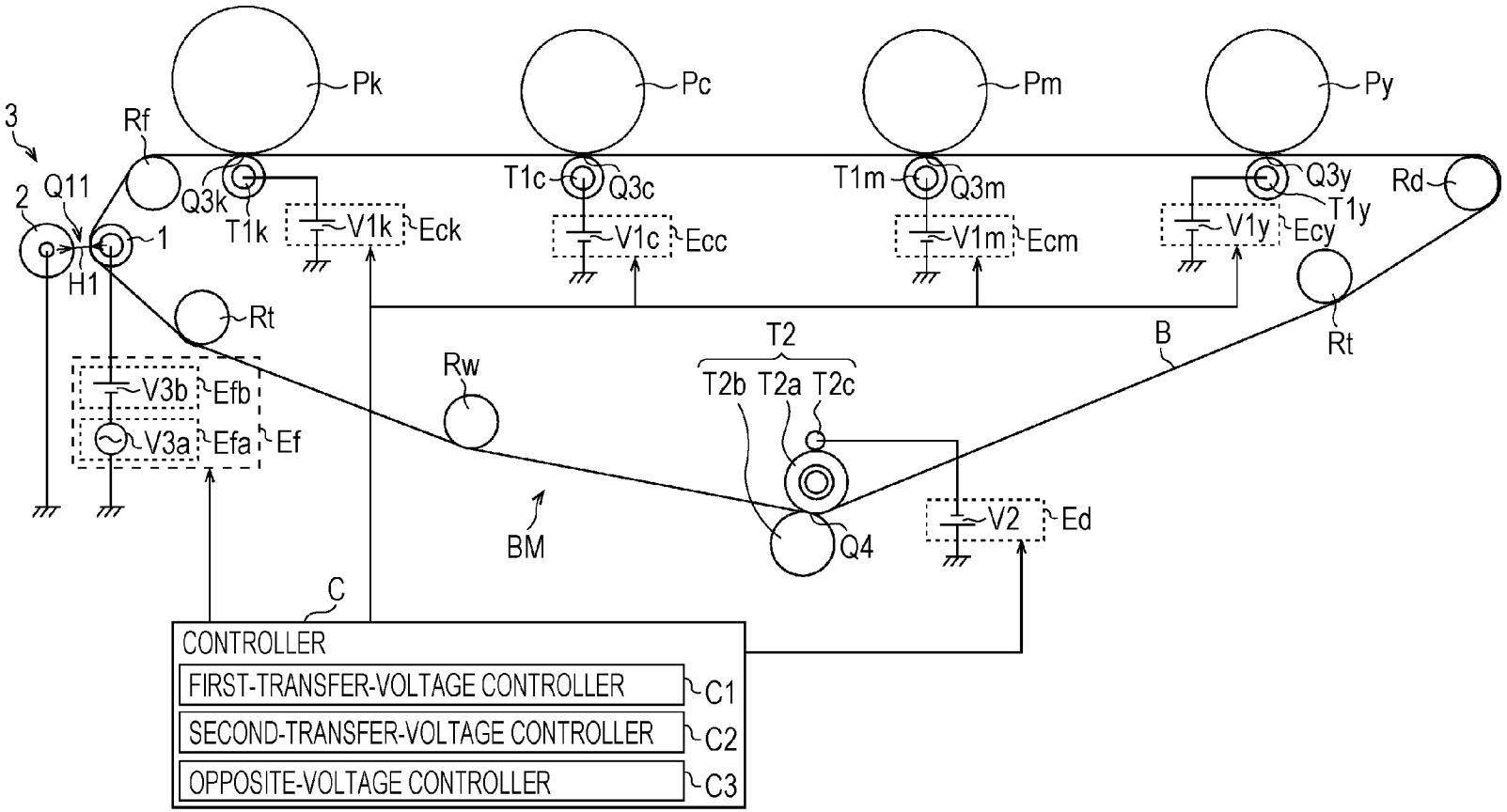
FIG. 3 is a diagram illustrating voltages to be applied to the transfer device of the first exemplary embodiment.

FIG. 3 is a diagram illustrating voltages to be applied to the transfer device of the first exemplary embodiment.

In FIG. 3, in the first exemplary embodiment, power supply circuits Ecy, Ecm, Ecc, and Eck for use in a first transfer process are respectively connected to the first transfer rollers T1*y*, T1*m*, T1*c*, and T1*k*. The power supply circuits Ecy to Eck for use in a first transfer process, each of which is an example of a first voltage application unit, apply only predetermined direct-current (DC) voltages V1*y*, V1*m*, V1*c*, and V1*k*, which are first transfer voltages, to the corresponding first transfer rollers T1*y*, T1*m*, T1*c*, and T1*k*. In other words, the power supply circuits Ecy to Eck for use in a first transfer process do not apply an alternating-current (AC) voltage whose polarity periodically reverses to the corresponding first transfer rollers T1*y*, T1*m*, T1*c*, and T1*k*.

In the first exemplary embodiment, a power supply circuit Ed for use in a second transfer process is connected to the contact roller T2*c* of the second transfer unit T2.

The power supply circuit Ed for use in a second transfer process, which is an example of a second voltage application unit, applies only a predetermined DC voltage V2, which is the second transfer voltage, to the contact roller T2*c*. In other words, the power supply circuit Ed for use in a second transfer process does not apply an AC voltage to the contact roller T2*c*. Here, the second transfer roller T2*b*, which is an example of a second transfer member, is electrically grounded. Thus, when the DC voltage V2 is applied to the contact roller T2*c*, an electric field that causes toners to be transferred onto one of the sheets S is generated between the backup roller T2*a*, which is in contact with the contact roller T2*c*, and the second transfer roller T2*b*. Note that, although the configuration in which the power supply circuit Ed is connected to the contact roller T2*c*, and in which the second transfer roller T2*b* is grounded has been described as an example in the first exemplary embodiment, the present invention is not limited to this. In other words, a configuration in which the contact roller T2*c* is grounded, and in which a power supply circuit is connected to the second transfer roller T2*b* in order to generate an electric field that causes the toners to be transferred onto the sheet S may be employed.

In the first exemplary embodiment, in the electric-field-generating member 3, an opposite power supply circuit Ef, which is an example of a voltage application unit, is connected to the support roller 1. The opposite power supply circuit Ef applies a sinusoidal AC voltage V3*a*, which is an example of an AC voltage whose polarity periodically reverses, to the support roller 1. In the first exemplary embodiment, the opposite power supply circuit Ef includes a power supply circuit Efa for an AC voltage and a power supply circuit Efb for a DC voltage and applies to the support roller 1 a voltage that is obtained by superposing the AC voltage V3*a* on a DC voltage V3*b*. When the voltage obtained by superposing the AC voltage V3*a* on the DC voltage V3*b* is applied to the support roller 1, an AC electric field, which is an example of an AC electric field, is generated between the support roller 1 and the opposing roller 2. Note that, although the configuration in which the opposite power supply circuit Ef is connected to the support roller 1, and in which the opposing roller 2 is grounded has been described as an example in the first exemplary embodiment, the present invention is not limited to this. In other words, a configuration in which the support roller 1 is grounded, and in which a power supply circuit is connected to the opposing roller 2 may be employed. Alternatively, a configuration in which a power supply circuit for a DC voltage is connected to the support roller 1, and in which a power supply circuit for an AC voltage is connected to the opposing roller 2 may be employed.

Note that, in the first exemplary embodiment, a two-component developer, which is a mixture of carrier that is charged so as to have a positive polarity and toner that is charged so as to have a negative polarity, is used as each of the developers as an example. Thus, toner images each having a negative polarity are held on the photoconductor drums Py to Pk of the first exemplary embodiment. Accordingly, in the first exemplary embodiment, the DC voltages V1*y* to V1*k*, each of which has a positive polarity and each of which is an example of a predetermined DC voltage, are respectively applied to the first transfer rollers T1*y* to T1*k*. In addition, the DC voltage V2, which has a negative polarity and which is an example of a predetermined DC voltage, is applied to the contact roller T2*c*. Furthermore, the DC voltage V3*b*, which has a positive polarity and which is an example of a predetermined DC voltage, is applied to the support roller 1.

In the first exemplary embodiment, the gap H1 in the electric-field-generating member 3 is set to 100 μm. However, the gap H1 is not limited to 100 μm. In other words, the gap H1 may be set to 20 μm or larger and 200 μm or smaller or to about 20 μm or larger and about 200 μm or smaller. In the case where the gap H1 is set to be smaller than 20 μm, it is difficult for toners to move when an electric field acts because the gap region Q11 is small. In the case where the gap H1 is set to be larger than 200 μm, such an electric field is likely to be weak because the gap region Q11 is too large. In other words, a force that acts on toners on the intermediate transfer belt B is small.

The first transfer rollers T1*y* to T1*k*, the intermediate transfer belt B, the second transfer unit T2, the belt cleaner CLB, the electric-field-generating member 3, the opposing cleaner 11, the power supply circuits Ecy to Eck, Ed, and Ef, and the like form a transfer device T1+B+T2+CLB of the first exemplary embodiment that transfers toner images on the photoconductor drums Py to Pk onto one of the sheets S.

(Description of Controller of First Exemplary Embodiment)

In FIG. 3, the controller C of the copying machine U includes an input/output interface I/O that inputs and outputs signals to the outside. In addition, the controller C includes a read only memory (ROM) in which programs, information, and the like for processing to be performed are stored. Furthermore, the controller C includes a random access memory (RAM) in which necessary data is to be temporarily stored. Furthermore, the controller C includes a central processing unit (CPU) that performs processing according to programs that are stored in ROM and the like. Accordingly, the controller C of the first exemplary embodiment is formed of a small-sized information processing apparatus, or specifically a microcomputer. Therefore, the controller C may realize various functions by executing the programs stored in ROM and the like.

The controller C of the first exemplary embodiment includes a first-transfer-voltage controller C1, a second-transfer-voltage controller C2, and an opposite-voltage controller C3.

The first-transfer-voltage controller C1, which is an example of a first power supply controller, controls the power supply circuits Ecy to Eck for use in a first transfer process in such a manner as to control the first transfer voltages V1*y* to V1*k*, which are respectively to be applied to the first transfer rollers T1*y* to T1*k*.

The second-transfer-voltage controller C2, which is an example of a second power supply controller, controls the power supply circuit Ed for use in a second transfer process in such a manner as to control the second transfer voltage V2, which is to be applied to the second transfer unit T2.

The opposite-voltage controller C3, which is an example of a power supply controller and an example of a controller that controls the voltage of an electric-field-generating member, controls the opposite power supply circuit Ef in such a manner as to control a voltage V3*a*+V3*b* that is to be applied to the electric-field-generating member 3. In other words, the opposite-voltage controller C3 applies the voltage V3*a*+V3*b*, which is obtained by superposing the AC voltage V3*a* on the DC voltage V3*b*, to the electric-field-generating member 3 via the power supply circuit Ef and forms an AC electric field, which is an example of an AC electric field, in the gap region Q11. In the first exemplary embodiment, the opposite-voltage controller C3 controls application and non-application of the voltage V3*a*+V3*b* in accordance with the type of one of the sheets S onto which toner images are to be transferred. More specifically, in the first exemplary embodiment, embossed paper, an example of a medium having large projections and depressions formed on its surface, is set beforehand. In addition, Japanese paper, an example of a medium having large variations in electric resistance, is set beforehand. Furthermore, normal paper, thin paper, and thick paper, examples of media having small projections and depressions formed on their surfaces in addition to small variations in electric resistance are each set beforehand.

In the case of transferring toner images onto embossed paper or Japanese paper, the opposite-voltage controller C3 of the first exemplary embodiment applies the voltage V3*a*+V3*b* to the electric-field-generating member 3 via the opposite power supply circuit Ef. In other words, in the case of transferring toner images onto embossed paper or Japanese paper, the opposite-voltage controller C3 forms an AC electric field in the gap region Q11. In the case of transferring toner images onto normal paper, thin paper, or thick paper, the opposite-voltage controller C3 of the first exemplary embodiment does not apply the voltage V3*a*+V3*b* to the electric-field-generating member 3. In other words, in the case of transferring toner images onto normal paper, thin paper, or thick paper, the opposite-voltage controller C3 stops the application of the voltage V3*a*+V3*b* and does not form an AC electric field in the gap region Q11. Note that, in the copying machine U of the first exemplary embodiment, the types of the sheets S, which are accommodated in the sheet feed trays TR1 to TR3, are beforehand input through the user interface U0. Thus, once a job, which is an example of an image forming operation, has been started, when one of the sheet feed trays TR1 to TR3 selected to be used, the type of the corresponding sheets S, which has been input in advance, may be obtained. Therefore, the opposite-voltage controller C3 of the first exemplary embodiment determines the type of the sheet S in accordance with one of the sheet feed trays TR1 to TR3 that is to be used and controls application and non-application of the voltage V3*a*+V3*b*.

(Operation of Transfer Device)

In the copying machine U of the first exemplary embodiment, which has the above-described configuration, once the copy start key has been input, images of the documents Gi, which have been set, are read. Then, the toner-image-forming members UY+GY to UK+GK form toner images of different colors in accordance with the read images. Here, the DC voltages V1*y* to V1*k* have been applied to the corresponding first transfer rollers T1*y* to T1*k*, and electric fields corresponding to the DC voltages V1*y* to V1*k* are formed in the first transfer regions Q3*y* to Q3*k*, in each of which one of the photoconductor drums Py to Pk and the intermediate transfer belt B face each other. Thus, the electric fields act on the corresponding toner images on the photoconductor drums Py to Pk, and as a result, the toner images are transferred in the first transfer process onto the intermediate transfer belt B. Along with a rotation of the intermediate transfer belt B, the toner images, which have been transferred to the intermediate transfer belt B, are transported to the gap region Q11, which is located on the downstream side in the rotation direction of the intermediate transfer belt B. An AC electric field is formed in the gap region Q11 of the first exemplary embodiment depending on the type of one of the sheets S onto which the toner images are to be transferred.

In other words, in the case of transferring the toner images onto embossed paper having large projections and depressions formed on its surface or Japanese paper having large variations in electric resistance, the voltage V3*a*+V3*b* is applied to the electric-field-generating member 3. Consequently, an AC electric field is formed between the opposing roller 2 and the support roller 1, that is, between the opposing roller 2 and the intermediate transfer belt B. Thus, when the toners on the intermediate transfer belt B pass through the gap region Q11, the AC electric field acts on the toners. Therefore, in the first exemplary embodiment, the toners vibrate by receiving a force that causes the toners to move toward and away from the intermediate transfer belt B in the gap region Q11. Here, since the DC voltage V3*b* is applied in the gap region Q11, even if the toners, which pass through the gap region Q11, have moved out of contact with the intermediate transfer belt B, the toners will eventually move onto the intermediate transfer belt B.

In the case of transferring the toner images onto normal paper, thin paper, or thick paper having small projections and depressions formed on its surface in addition to small variations in electric resistance, the application of the voltage V3*a*+V3*b* is stopped. Consequently, such an AC electric field does not act on the toner images on the intermediate transfer belt B when the toner images pass through the gap region Q11. Thus, the toner images pass through the gap region Q11 while being held on the intermediate transfer belt B.

The toner images, which have passed through the gap region Q11, are transported to the second transfer region Q4. Here, the DC voltage V2 is applied to the second transfer unit T2. Consequently, an electric field corresponding to the DC voltage V2 is generated in the second transfer region Q4. In other words, when the sheet S is delivered to the second transfer area Q4 in accordance with the timing at which the toner images on the intermediate transfer belt B are transported to the second transfer region Q4, an electrostatic force acts on the toner images on the intermediate transfer belt B, and the toner images are transferred in a second transfer process onto the sheet S.

Note that the sheet S, to which the toner images have been transferred, passes through the fixing device F and the like and is ejected to the ejection tray TH1.

In Japanese Unexamined Patent Application Publication No. 2012-63746 (hereinafter referred to as Patent Document 1) and Japanese Unexamined Patent Application Publication No. 2012-42827 (hereinafter referred to as Patent Document 2), when toner images on an intermediate transfer belt are transferred onto a sheet, a voltage that is obtained by superposing an AC voltage on a DC voltage is applied. In other words, in Patent Documents 1 and 2, in the case of transferring toner images onto a sheet having large projections and depressions formed on its surface, a voltage that is obtained by superposing an AC voltage on a DC voltage is applied. In Patent Documents 1 and 2, this facilitates transfer of toners to the depressions in the sheet surface, so that formation of a gradation pattern that follows the shapes of the projections and the depressions, which are formed on the sheet surface, is suppressed. Note that, according to Patent Documents 1 and 2, in the case where an AC voltage is superposed on a DC voltage, the toners on the intermediate transfer belt vibrate while each of the depressions of the sheet serves as a space. When the toners vibrate in the depressions, the vibrating toner particles come into contact with toner particles remaining on the intermediate transfer belt. As a result, the toners remaining on the intermediate transfer belt moves. This process is repeated, and the toner particles whose adhesion force has decreased move and come into contact with toner particles still remaining on the intermediate transfer belt. Consequently, the adhesion force of the toners to the intermediate transfer belt decreases. Therefore, in a configuration in which only a DC voltage is applied, the adhesion force of the toners will not decrease, and it is not likely that the toners will be transferred onto the depressions. However, in the case where an AC voltage is superposed on a DC voltage, the transfer of the toners to the depressions is facilitated.

Here, the DC voltage that causes the toners to be transferred onto the sheet S needs to be set with consideration given to the resistance of the sheet S. In particular, the required magnitude of the DC voltage in the second transfer region Q4 has been increasing along with the recent demands for increasing the speed of copying machines and the use of thick paper as a medium. Thus, there is a tendency for the voltage to be applied in the second transfer region Q4 to increase.

In addition, the AC voltage that is superposed with the DC voltage in the second transfer region Q4 needs to be set in accordance with the DC voltage. For example, in Patent Document 2, the difference between the maximum value and the minimum value of an AC voltage, which is the so-called peak-to-peak voltage Vpp, is set to be four times or more the DC voltage. In Patent Document 1, the peak-to-peak voltage Vpp is set to be six times or more the DC voltage. Therefore, when trying to satisfy the setting described in Patent Document 2 while considering the increase in voltage to be used in recent years, the peak-to-peak voltage Vpp may sometimes be about 10 kV. In other words, as the set value of a DC voltage increases, the peak-to-peak voltage Vpp of an AC voltage is likely to further increase. With a configuration in which such a high voltage is to be applied, electric discharge is likely to occur when toner images are transferred onto one of the sheets S. In the case where electric discharge occurs at the time of transferring the toner images, there is the probability of an image quality defect, which is a phenomenon in which a portion of an image is missed, such an image quality defect being so-called white spots. In addition, it is probable that deterioration of the members included in the transfer device T1+B+T2+CLB, such as the intermediate transfer belt B, will be accelerated and that the service lives of the members will be reduced.

In contrast, in the first exemplary embodiment, in the case of transferring toner images onto embossed paper or Japanese paper, an AC electric field is formed not in the second transfer region Q4 but in the gap region Q11, which is located upstream of the second transfer region Q4. In addition, toners that pass through the gap region Q11 are caused to vibrate and the like by applying a force that causes the toners to move away from the intermediate transfer belt B to the toners, so that the adhesion force of the toners to the intermediate transfer belt B is reduced. In this case, in the first exemplary embodiment, the AC electric field is formed without involving any one of the sheets S. Thus, in the first exemplary embodiment, unlike in the second transfer region Q4, there is no need to consider the resistance of the sheets S, and the AC voltage does not need to be set on the basis of the DC voltage required for transferring toner images onto one of the sheets S. Therefore, the AC voltage V3*a* may be easily set while only intending to reduce the adhesion force of the toners, and a situation in which the peak-to-peak voltage of the AC voltage V3*a* becomes excessively large may be easily avoided. In addition, the DC voltage V3*b* may be set to such an extent that the toners, which vibrate, will not move to the opposing roller 2, and a situation in which the DC voltage V3*b* becomes excessively large may be easily avoided. Accordingly, the magnitude of the voltage V3*a*+V3*b* that is applied in the gap region Q11 may be easily reduced.

The adhesion force of the toner images on the intermediate transfer belt B is reduced before the toner images are delivered to the second transfer region Q4. The absolute value of the DC voltage V2, which is to be applied, may be easily reduced compared with the case where the adhesion force of the toners is large. Thus, in the first exemplary embodiment, in the second transfer region Q4, the magnitude of the voltage V2, which is to be applied, may also be easily reduced. Accordingly, even if there are variations in the magnitude of the voltage V2 due to noise and the like at the time of applying the DC voltage V2, the peak voltage of the DC voltage V2 is likely to be small.

Therefore, in the first exemplary embodiment, the probability of the occurrence of electric discharge is reduced compared with the case where the AC voltage that reduces the adhesion force of the toners is applied in the second transfer region Q4, and the deterioration of the members included in the transfer device T1+B+T2+CLB is likely to be suppressed. In addition, occurrence of white spots in an image is suppressed. Consequently, in the first exemplary embodiment, electric-discharge defects such as white spots that occur in an image and the deterioration of the members included in the transfer device T1+B+T2+CLB are less likely to occur. In addition, in the first exemplary embodiment, a transfer failure is likely to be suppressed.

In general, in a configuration in which toners are caused to vibrate in the second transfer region Q4, such as those described in Patent Documents 1 and 2, in the case where Japanese paper having variations in electric resistance is used, unevenness in a transfer electric field is generated in accordance with the variations in electric resistance. In the case where the adhesion force of toners is large, it may sometimes be difficult to transfer the toners onto one of the sheets S at a position where the intensity of the transfer electric field is low. Thus, when the toner images are transferred onto the sheet S, unevenness in the density of the toner images may sometimes be generated in accordance with the unevenness in the transfer electric field. Therefore, it is desirable that the adhesion force of the toners be reduced beforehand in the case where Japanese paper or the like is used.

Here, in the first exemplary embodiment, the adhesion force of the toners is reduced in the gap region Q11, which is located upstream of the second transfer region Q4. Thus, the toner images are delivered to the second transfer region Q4 in a state where the adhesion force of the toners has been reduced. Therefore, even if unevenness in the transfer electric field is generated, the toner images on the intermediate transfer belt B may be easily transferred onto the sheet S. In other words, in the first exemplary embodiment, compared with the case where the adhesion force of the toners is not reduced before the toner images are delivered to the second transfer region Q4, the toner images may be easily transferred onto Japanese paper having large variations in electric resistance without generating unevenness in the density of the toner images.

In the first exemplary embodiment, in the case of transferring toner images onto normal paper, thin paper, or thick paper, the voltage V3*a*+V3*b* is not applied to the electric-field-generating member 3. In the case of transferring toner images onto embossed paper or Japanese paper, the voltage V3*a*+V3*b* is applied to the electric-field-generating member 3. Here, projections and depressions formed on surfaces of such normal paper, thin paper, and thick paper are small. In addition, such normal paper and the like have small variations in electric resistance. Thus, even if a configuration in which the adhesion force of toners is not reduced, and in which only the DC voltage V2 is applied is employed, in the case of transferring toner images onto normal paper or the like, which is used as one of the sheets S, the toner images may be easily transferred onto the sheet S. Accordingly, in the first exemplary embodiment, toner images may be easily transferred while reducing power consumption compared with the case where a voltage that reduces the adhesion force of toners is always applied regardless of the type of the sheet S used. In other words, the first exemplary embodiment achieves energy saving.

Note that, in the first exemplary embodiment, the gap H1 in the gap region Q11 is set to 100 μm. This helps toners vibrate when an AC electric field acts on the toners. Note that in the case where each of the toners has a particle diameter of 5 μm as an example, the toners are likely to vibrate especially when the gap H1 is 20 μm or larger and 200 μm or smaller or is about 20 μm or larger and about 200 μm or smaller.

The opposing cleaner 11 is disposed for cleaning the opposing roller 2 of the first exemplary embodiment. When the toners vibrate in the gap region Q11, it is probable that the toners will adhere to a portion of the surface of the opposing roller 2. In the case where the toners adhere to the opposing roller 2, it is probable that the toners, which have adhered to the opposing roller 2, will become mixed into subsequent toner images when the subsequent toner images pass through the gap region Q11, resulting in deterioration of the image quality of the subsequent toner images. However, in the first exemplary embodiment, the opposing roller 2 rotates when a job is started. Thus, even if the toners adhere to a portion of the surface of the opposing roller 2, the opposing roller 2 rotates in such a manner that the portion of the surface of the opposing roller 2 is moved to the position where the opposing cleaner 11 is disposed, and the blade 13 cleans the portion of the surface of the opposing roller 2. Therefore, in the first exemplary embodiment, the deterioration of the image quality of subsequent toner images is suppressed.

EXAMPLES

Next, experiments are performed to confirm the effects of the first exemplary embodiment.

In the experiments, a 700 Digital Color Press manufactured by Fuji Xerox Co., Ltd. is used as an image forming apparatus U, and the transfer device T1+B+T2+CLB modified for the experiments is used.

More specifically, the following configuration is employed.

The intermediate transfer belt B has a two-layer structure. Each of the layers is fabricated by dispersing carbon black in a polyimide resin. One of the layers that serves as the outer peripheral surface of the intermediate transfer belt B is 67 μm, and the other one of the layers that serves as the inner peripheral surface of the intermediate transfer belt B is 33 μm. The volume resistivity of the intermediate transfer belt B is 12.5 log Ω·cm. The surface resistivity of the inner peripheral surface is 10.3 log Ω/□. Here, volume resistivity and surface resistivity are measured by using an R8340A digital ultra-high resistance/micro current meter (manufactured by Advantest Corporation) and a UR probe MCP-HTP12 (manufactured by Dia Instruments Co., Ltd.). When the volume resistivity of the intermediate transfer belt B is measured, a voltage of 500 V is applied to the intermediate transfer belt B for 10 seconds in a state where a load of 19.6 N is applied to the intermediate transfer belt B. Volume resistivity and surface resistivity are measured in an environment with a room temperature of 22° C. and a humidity of 55%.

In the second transfer unit T2, the backup roller T2*a* has a diameter of 20 mm. In addition, the volume resistance value of the backup roller T2*a* is 6.5 log·Ω, and the hardness of the backup roller T2*a* is 65 degrees (Asker C). The second transfer roller T2*b* has a diameter of 24 mm. In addition, the volume resistance value of the second transfer roller T2*b* is 7.0 log·Ω, and the hardness of the second transfer roller T2*b* is 75 degrees (Asker C).

In the electric-field-generating member 3, the support roller 1 has a diameter of 20 mm. In addition, the volume resistance value of the support roller 1 is 6.5 log·Ω, and the hardness of the support roller 1 is 65 degrees (Asker C). The opposing roller 2 has a diameter of 24 mm. In addition, the volume resistance value of the opposing roller 2 is 7.0 log·Ω, and the hardness of the opposing roller 2 is 75 degrees (Asker C). The opposing roller 2 used in the experiments is supported in such a manner as to be capable of moving toward and away from the intermediate transfer belt B, such that the gap H1 is adjustable.

Note that the experiments are performed in an environment with a room temperature of 22° C. and a humidity of 55%.

Example 1-1

In Example 1-1, regarding the voltage applied to the electric-field-generating member 3, the DC voltage V3*b* is 0.6 kV. The AC voltage V3*a* is 3.6 kV (Vpp=3.6 kV). Note that Vpp is the peak-to-peak voltage of an AC voltage. The gap H1 in the electric-field-generating member 3 is 200 μm.

Regarding the voltage applied to the second transfer unit T2, the AC voltage is 0 kV (Vpp=0 kV). In other words, the AC voltage is not applied to the second transfer unit T2. The DC voltage is −4 kV (Vdc=−4 kV). Note that Vdc is the value of a DC voltage.

Under conditions of the above-mentioned voltages, a toner image of a solid image is transferred onto embossed paper (Leathac 66, 250 gsm), which serves as one of the sheets S, while the transport speed of the sheet S is 440 mm/s. Evaluation of emboss grade (G), which is the sensory evaluation of the transferability of toner onto embossed paper, and evaluation of the degree of occurrence of white spots are performed. Emboss grade G0 denotes the best transferability. As the number of G increases, the transferability deteriorates, and G2 is considered an acceptable level.

In addition, the transferability of toner onto Japanese paper is evaluated by using Japanese paper (mandala, pure white, thick A3, manufactured by MOLZA Corporation).

During evaluation of the transferability of toner onto Japanese paper, a so-called process black 300% patch image that is formed by superposing 100% patches of the three colors Y, M, and C on top of one another is used. In the process black 300% patch, in the case where the density of Y, which serves as the lowermost layer on the paper, is 1.8 or greater, the transferability is evaluated as good. In the case where the density of Y of the process black 300% patch is less than 1.8, the transferability is evaluated as poor. Note that process black is formed by superposing Y, M, and C in this order. Thus, the thickness and the amount of toner used to produce a process black toner image are larger than those of a black toner image formed of only K color toner.

In addition, a resistance-reduction amount of the intermediate transfer belt B is measured after 10,000 normal A4 sheets have been printed. Note that as the resistance of the intermediate transfer belt B decreases, the intermediate transfer belt B deteriorates.

Example 1-2

In Example 1-2, the gap H1 in the electric-field-generating member 3 is 20 μm. The rest of the conditions are the same as those of Example 1-1, and the measurement is performed in a similar manner to Example 1-1.

Example 1-3

In Example 1-3, the gap H1 in the electric-field-generating member 3 is 10 μm. Note that a value of 10 μm is not within a particularly desirable numerical range for the gap H1. The rest of the conditions are the same as those of Example 1-1, and the measurement is performed in a similar manner to Example 1-1.

Example 1-4

In Example 1-4, the gap H1 in the electric-field-generating member 3 is 250 μm. Note that a value of 250 μm is not within the particularly desirable numerical range for the gap H1. The rest of the conditions are the same as those of Example 1-1, and the measurement is performed in a similar manner to Example 1-1.

Comparative Example 1

In Comparative Example 1, regarding the voltage applied to the electric-field-generating member 3, the DC voltage V3*b* is 0 kV. The AC voltage V3*a* is 0 kV (Vpp=0 kV). In other words, in Comparative Example 1, no voltage is applied to the electric-field-generating member 3. The gap H1 is 0 μm. In other words, there is not gap. Thus, in Comparative Example 1, toner does not vibrate on the upstream side of the second transfer region Q4.

In addition, regarding the voltage applied to the second transfer unit T2, the AC voltage is 0 kV. The DC voltage is −4 kV (Vdc=−4 kV).

In other words, in Comparative Example 1, the toner image is transferred onto the sheet S only by the DC voltage without causing the toner to vibrate.

The rest of the conditions are the same as those of Example 1-1, and the measurement is performed in a similar manner to Example 1-1.

Comparative Example 2

In Comparative Example 2, regarding the voltage applied to the second transfer unit T2, the DC voltage is −1.6 kV (Vdc=−1.6 kV). The AC voltage is 9.6 kV (Vpp=9.6 kV). Thus, the maximum value of the absolute value of the voltage that is applied to the second transfer unit T2 is 6.4 kV. Note that, in a configuration in which a voltage obtained by superposing an AC voltage on a DC voltage is used as a second transfer voltage, the magnitude of the DC voltage may be set to about 40% of a voltage used in the case where the toner image is transferred onto the sheet S by only a DC voltage. The rest of the conditions are the same as those of Comparative Example 1, and the measurement is performed in a similar manner to Comparative Example 1.

Comparative Example 3

In Comparative Example 3, regarding the voltage applied to the second transfer unit T2, the DC voltage is −1.6 kV (Vdc=−1.6 kV). The AC voltage is 6.0 kV (Vpp=6.0 kV). Thus, the maximum value of the absolute value of the voltage that is applied to the second transfer unit T2 is 4.6 kV. The rest of the conditions are the same as those of Comparative Example 1, and the measurement is performed in a similar manner to Comparative Example 1.

Experimental Results of Examples 1-1 to 1-4 and Comparative Examples 1 to 3

FIGS. 4A and 4B are respectively a table and a diagram illustrating Examples 1-1 to 1-4 and Comparative Examples 1 to 3. FIG. 4A shows the experimental conditions and experimental results, and FIG. 4B shows a criterion for the evaluation of emboss grade (G).

In FIG. 4, in Examples 1-1 to 1-4 and Comparative Example 1, in each of which only the DC voltage is applied in the second transfer region Q4, no white spot is observed. In addition, no decrease in the resistance of the intermediate transfer belt B is observed. In contrast, in Comparative Examples 2 and 3, in each of which the AC voltage is superposed on the DC voltage at the time of a second transfer process, white spots are observed. In addition, a decrease in the resistance of the intermediate transfer belt B is observed. Therefore, it is confirmed that problems associated with electric discharge occur in a configuration in which an AC voltage is superposed on a DC voltage in the second transfer region Q4.

There is a difference between Examples 1-1 to 1-4 and Comparative Example 1, and the difference is whether an AC electric field acts on the toner in the gap region Q11. In Comparative Example 1, in which such an AC electric field does not act on the toner, the emboss grade G is evaluated as G6, which is the lowest grade. On the other hand, in each of Examples 1-1 to 1-4, in the worst case, the emboss grade G is evaluated as G5.5, which is a higher grade than G6, which is the lowest grade. As a result, it is confirmed that, in the case of transferring a toner image by a DC voltage, transferability of toner onto embossed paper is further improved when an AC electric field acts on the toner in the gap region Q11.

In Example 1-1, in which the gap H1 is 200 μm, the emboss grade G is evaluated as G2. In Example 1-2, in which the gap H1 is 20 μm, the emboss grade G is evaluated as G1. In Example 1-3, in which the gap H1 is 10 μm, the emboss grade G is evaluated as G5. In Example 1-4, in which the gap H1 is 250 μm, the emboss grade G is evaluated as G5.5.This shows that the evaluation of emboss grade G varies depending on the size of the gap H1. In particular, in Example 1-1 and Example 1-2, the emboss grade G is evaluated as at the acceptable level. In contrast, in Example 1-3 and Example 1-4, the emboss grade G is not evaluated as at the acceptable level.

This is presumably because, in the case where the toner has a particle diameter of about 5 μm, the gap H1 in Example 1-3, which is 10 μm, is too small for the toner to vibrate as a result of the AC electric field acting on the toner. Contrary to this, in Example 1-4, in which the gap H1 is 250 μm, it is assumed that the intensity of the electric field, which is generated by applying a voltage, is low because the gap is too large, and which makes it difficult for the toner to receive a force that causes the toner to vibrate.

Therefore, it is confirmed that it is particularly desirable that the gap H1 be set to 20 μm or larger and 200 μm or smaller or to about 20 μm or larger and about 200 μm or smaller.

In Examples 1-1 and 1-2, in each of which the emboss grade G is evaluated as G2 or G1, the transferability of the toner onto Japanese paper is improved compared with Examples 1-3 and 1-4 and Comparative Examples 1 to 3. Therefore, it is confirmed that, in the case where the adhesion force of the toner is reduced before the toner image is delivered to the second transfer region Q4, good transferability may be obtained even if the sheet S has variations in electric resistance.

Note that the emboss grade G is evaluated as G2 in Comparative Example 2. Thus, the evaluation of emboss G, which is at the acceptable level, may be obtained also in a configuration in which an AC voltage is superposed on a DC voltage in the second transfer region Q4. However, in Comparative Example 2, the peak-to-peak voltage of the AC voltage is likely to be large. Consequently, in Comparative Example 2, problems such as the occurrence of white spots and a larger resistance-reduction amount of the intermediate transfer belt B occur compared with Example 1-1 in which the emboss grade G is evaluated as G2, which is the same as that in Comparative Example 2. In addition, transferability of the toner onto the Japanese paper is not obtained.

Example 2

In Example 2, the magnitude of a force that is applied to toner on the intermediate transfer belt B in the second transfer region Q4 is simulated on the basis of the configuration of the image forming apparatus U, which is used in the experiments. In Example 2, an electrostatic force that is applied to the toner on the intermediate transfer belt B is simulated by applying the second transfer voltage V2 to normal paper, Japanese paper, and embossed paper (hereinafter referred to as normal paper S1, Japanese paper S2, and embossed paper S3, respectively). In addition, in Example 2, the adhesion force of the toner in the configuration employed in Comparative Example 1 and the adhesion force of the toner in the configuration employed in Example 1-2 are measured. In other words, the adhesion forces in the case where an AC electric field acts on the toner and in the case where an AC electric field does not act on the toner are measured.

Experimental Results of Example 2

Figure 5A:
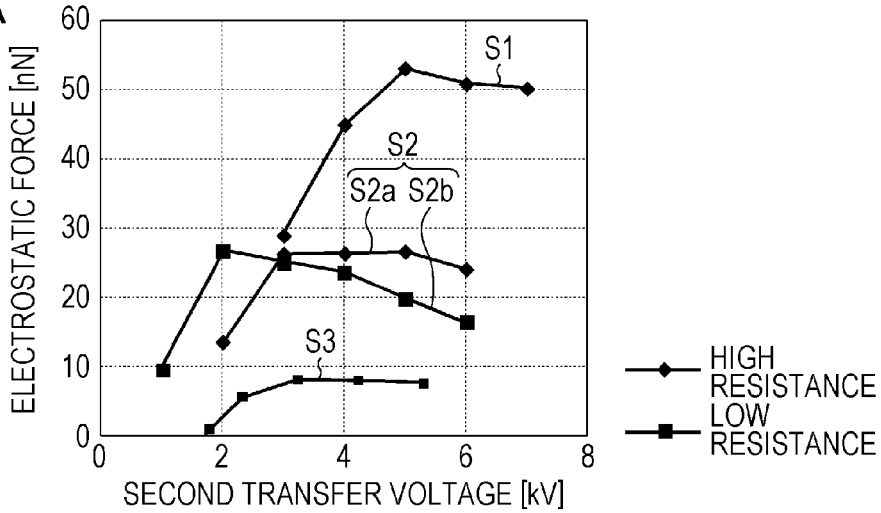
FIGS. 5A, 5B, and 5C are graphs showing the experimental results of Example 2, FIG. 5A showing relationships between a second transfer voltage and an electrostatic force in the cases where sheets are nipped in a second transfer area, FIG. 5B showing the adhesion force of toner in the case where an alternating-current electric field acts on the toner and the adhesion force of the toner in the case where the alternating-current electric field does not act on the toner, and FIG. 5C showing a graph, which is a combination of FIG. 5A and FIG. 5B.
Figure 5B:
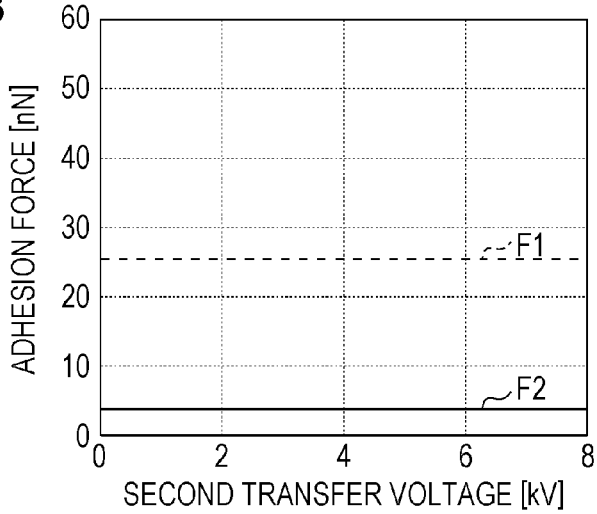
Figure 5C:
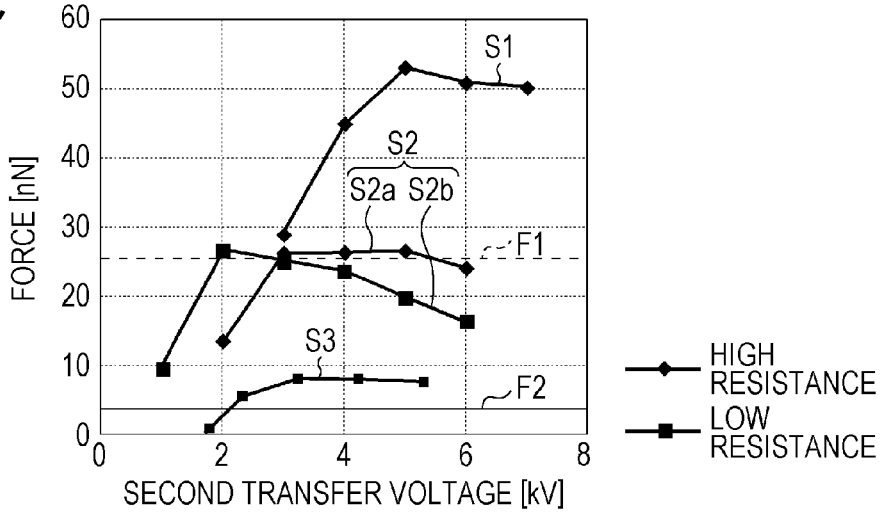

FIGS. 5A, 5B, and 5C are graphs showing the experimental results of Example 2. FIG. 5A shows relationships between the second transfer voltage V2 and an electrostatic force in the cases where the sheets S1 to S3 are nipped in the second transfer region Q4. FIG. 5B shows the adhesion force of the toner in the case where the AC electric field acts on the toner and the adhesion force of the toner in the case where the AC electric field does not act on the toner. FIG. 5C shows a graph, which is a combination of FIG. 5A and FIG. 5B. In FIGS. 5A, 5B, and 5C, the horizontal axis represents the second transfer voltage V2 [kV], which is to be applied. The vertical axis represents a force [nN] that acts on the intermediate transfer belt B.

In FIG. 5A, when the normal paper S1 is disposed in the second transfer region Q4, the gap between the intermediate transfer belt B and the second transfer roller T2*b* is 5 μm. Here, it is found that, when the second transfer voltage V2 of about 3 kV is applied, an electrostatic force of about 30 nN is applied to the toner on the intermediate transfer belt B. In addition, a tendency for the electrostatic force to increase is observed when the applied second transfer voltage V2 is increased. However, when the second transfer voltage V2 of about 5 kV is applied, the electrostatic force is about 53 nN, and it is found that, even if the second transfer voltage V2 is further increased, the electrostatic force decreases to about 50 nN, which is smaller than about 53 nN.

When the Japanese paper S2 is disposed in the second transfer region Q4, the gap between the intermediate transfer belt B and the second transfer roller T2*b* is 10 μm. Here, Japanese paper has large variations in electric resistance. Thus, the electrostatic force that is applied to the toner in a high resistance portion S2*a* of the Japanese paper S2 and the electrostatic force that is applied to the toner in a low resistance portion S2*b* of the Japanese paper S2 are separately simulated. In the high resistance portion S2*a*, it is found that, when the second transfer voltage V2 of about 2 kV is applied, an electrostatic force of about 14 nN is applied to the toner on the intermediate transfer belt B. In addition, there is a tendency for the electrostatic force to increase is increased when the second transfer voltage V2, which is applied. However, it is found that the electrostatic force is about 28 nN even if the second transfer voltage V2 is increased in the range of about 3 kV to about 5 kV. In addition, when the second transfer voltage V2 is increased to about 6 kV, a decrease in the electrostatic force is observed. It is found that the relationship between the second transfer voltage V2 and the electrostatic force in the low resistance portion S2*b* has a tendency similar to that between the second transfer voltage V2 and the electrostatic force in the high resistance portion S2*a*. However, overall, it is found that the electrostatic force in the low resistance portion S2*b*, is similar to that in the high resistance portion S2*a* when the second transfer voltage V2 is low.

Therefore, it is confirmed that uneven distribution of the electrostatic force between the low resistance portion S2*b* and the high resistance portion S2*a* is likely to be generated even if the magnitudes of the second transfer voltages V2 applied in the low resistance portion S2*b* and the high resistance portion S2*a* are the same as each other.

When the embossed paper S3 is disposed in the second transfer region Q4, the gap between the intermediate transfer belt B and the second transfer roller T2*b* is 70 μm. In the case of the embossed paper S3, there is a tendency for the electrostatic force to increase as the second transfer voltage V2 increases in the range of about 1.8 kV to about 3.2 kV. However, when the second transfer voltage V2 is greater than about 3.2 kV, no change is observed in the magnitude of the electrostatic force. Note that, in the case of the embossed paper S3, the overall electrostatic force, which is generated, is small and is smaller than 10 nN.

In FIG. 5B, in the case where an AC electric field does not act on the toner, an observed adhesion force F1 of the toner is about 28 nN indicated by a dashed line. In the case where the toner vibrates as a result of the AC electric field acting on the toner, an observed adhesion force F2 of the toner is about 4 nN indicated by a solid line. Therefore, it is confirmed that the adhesion force of the toner is reduced in the case where the AC electric field acts on the toner.

Here, in the cases of transferring the toner onto the sheets S1 to S3, an electrostatic force larger than the adhesion force of the toner needs to be applied to the toner. In other words, in FIG. 5C, only in the cases of the normal paper S1 and the Japanese paper S2, the electrostatic force exceeds the adhesion force F1 of the toner, which is observed in the case where the AC electric field does not act on the toner. In addition, in the case of the Japanese paper S2, there is a tendency for the electrostatic force to fall below the adhesion force F1 in the low resistance portion S2*b* when the electrostatic force exceeds the adhesion force F1 in the high resistance portion S2*a*, and there is a tendency for the electrostatic force to exceed the adhesion force F1 in the low resistance portion S2*b* when the electrostatic force falls below the adhesion force F1 in the high resistance portion S2*a*. Therefore, it is understood that transfer unevenness is likely to occur in the case of the Japanese paper S2. In the case of the embossed paper S3, since the electrostatic force falls below the adhesion force of the toner, it is difficult to transfer the toner onto the embossed paper S3.

However, the electrostatic force in the case of the embossed paper S3 exceeds the adhesion force F2 of the toner, which is reduced by the AC electric field. In addition, in the high resistance portion S2*a* and the low resistance portion S2*b* of the Japanese paper S2, the electrostatic force is likely to exceed the adhesion force F2 of the toner. Therefore, it is confirmed that, in the first exemplary embodiment, in which the adhesion force of toners is reduced by causing an AC electric field to act on the toner, transfer of toners to embossed paper and Japanese paper may be easily performed. Note that it is also confirmed that toners may be transferred onto normal paper without reducing the adhesion force of the toners.

[Second Exemplary Embodiment]

A second exemplary embodiment of the present invention will now be described. However, in the description of the second exemplary embodiment, components that correspond to the components of the first exemplary embodiment are denoted by the same reference numerals as those of the components of the first exemplary embodiment, and detailed descriptions thereof will be omitted.

The second exemplary embodiment is configured similar to the first exemplary embodiment other than the differences described below.

(Description of Transfer Device of Second Exemplary Embodiment)

Figure 6:
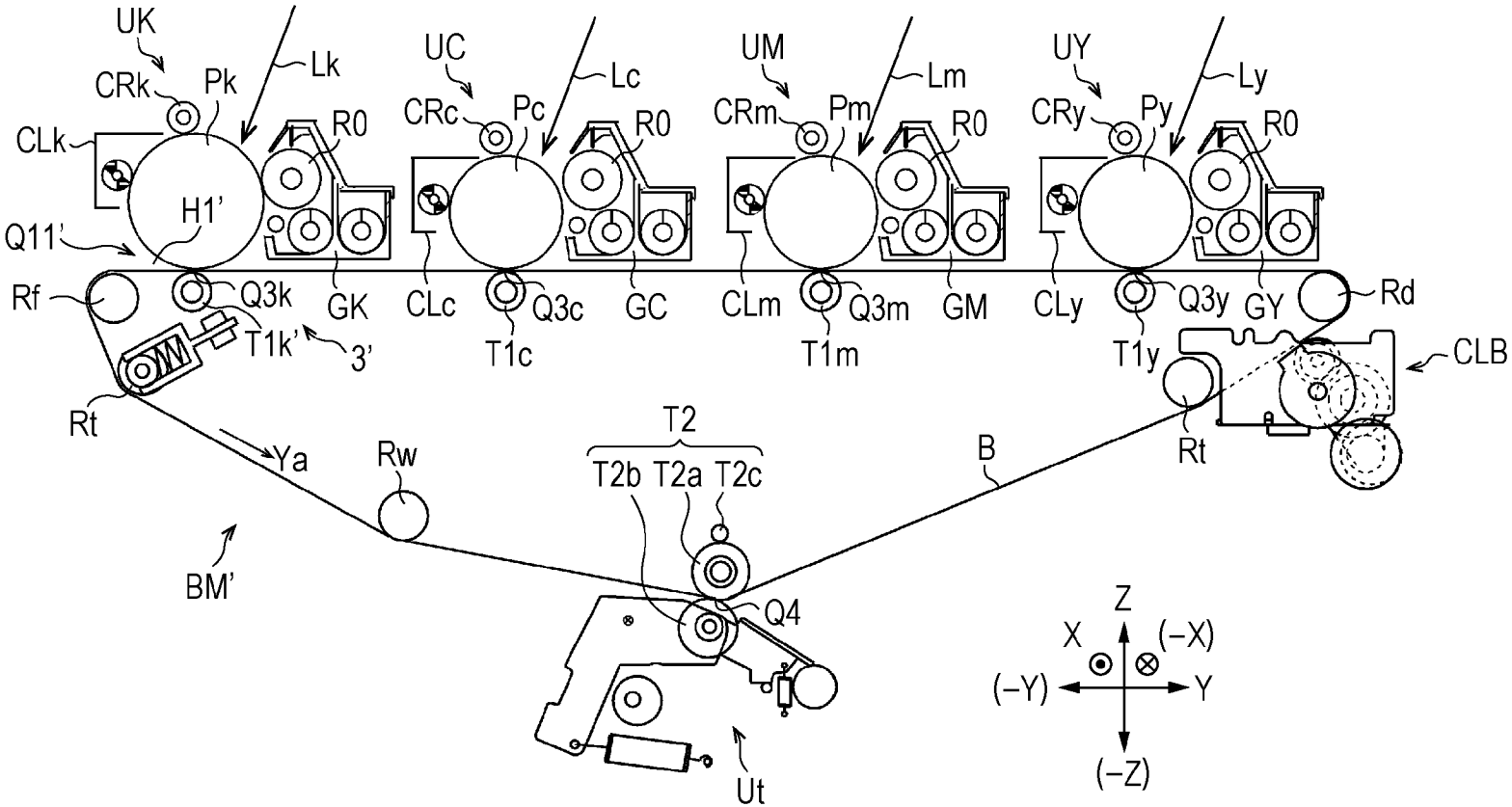
FIG. 6 is a diagram illustrating a transfer device of a second exemplary embodiment and corresponding to FIG. 2, which illustrates the first exemplary embodiment.

FIG. 6 is a diagram illustrating a transfer device of the second exemplary embodiment and corresponding to FIG. 2, which illustrates the first exemplary embodiment.

In FIG. 6, the support roller 1, the opposing roller 2, and the opposing cleaner 11 of the first exemplary embodiment are omitted in a belt module BM' of the second exemplary embodiment. In the second exemplary embodiment, a first transfer rollers T1*k*' for color K, which is an example of an electric-field-generating member and an example of opposing member, is disposed at a position facing the photoconductor drum Pk, which is located on the most downstream side in the rotation direction of the intermediate transfer belt B, with the intermediate transfer belt B interposed therebetween. In other words, an opposing member of the second exemplary embodiment is formed of the first transfer rollers T1*k*', which is located on the most downstream side.

In the second exemplary embodiment, a gap region Q11' of the second exemplary embodiment is formed of a gap H1' having a wedge-shaped cross section in which the intermediate transfer belt B and the photoconductor drum Pk face each other and that is positioned downstream of a first transfer region Q3*k*, which is an example of an area in which the photoconductor drum Pk and the intermediate transfer belt B are in contact with each other.

A electric-field-generating member 3' of the second exemplary embodiment is formed of the photoconductor drum Pk, which is located on the most downstream side, and the first transfer rollers T1*k*', which is located on the most downstream side.

Figure 7:
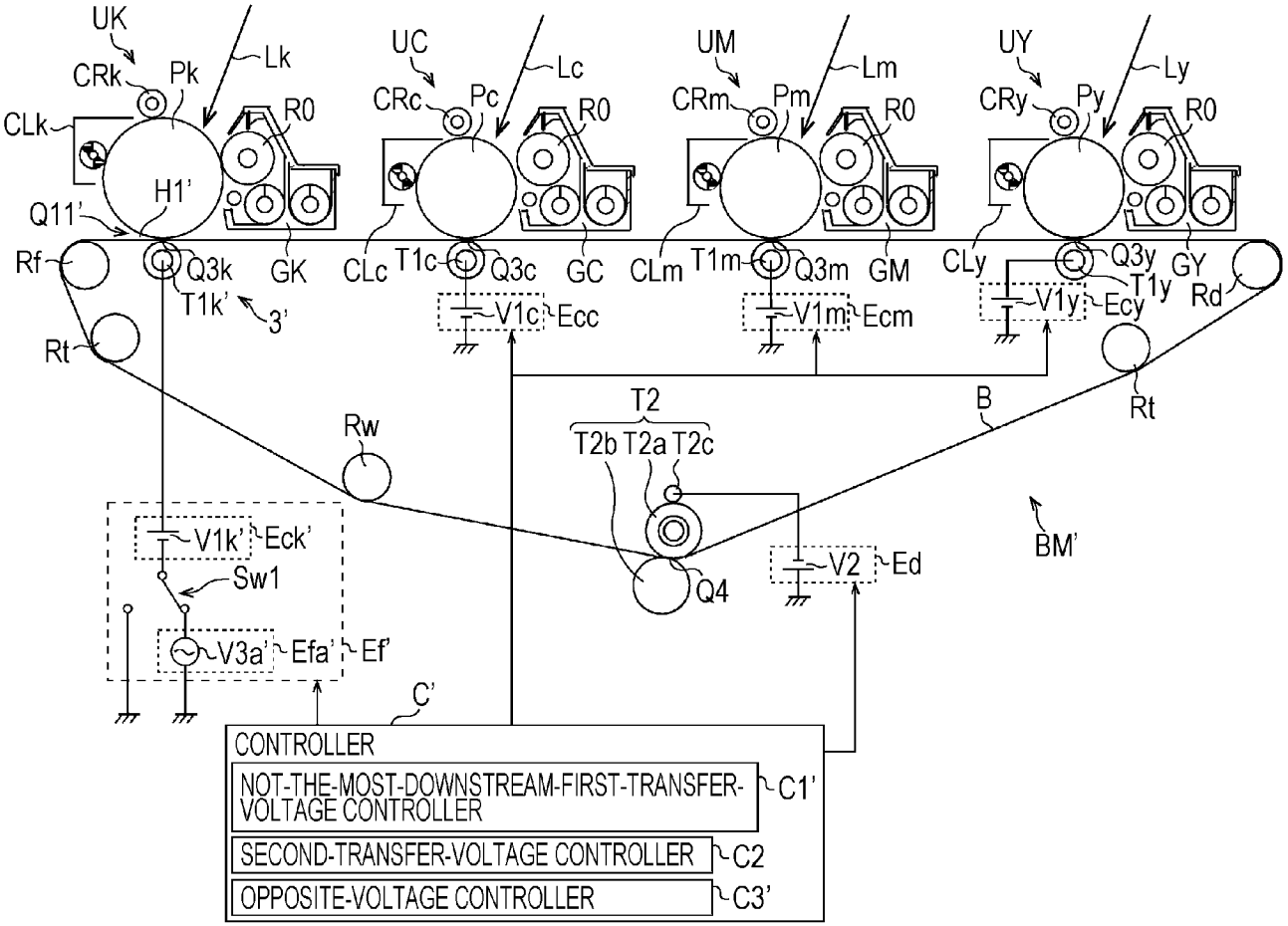
FIG. 7 is a diagram illustrating voltages to be applied to the transfer device of the second exemplary embodiment and corresponding to FIG. 3, which illustrates the first exemplary embodiment.

FIG. 7 is a diagram illustrating voltages to be applied to the transfer device of the second exemplary embodiment and corresponding to FIG. 3, which illustrates the first exemplary embodiment.

In FIG. 7, in the second exemplary embodiment, the power supply circuits Ecy, Ecm, and Ecc for use in a first transfer process are respectively connected to the first transfer rollers T1*y*, T1*m*, and T1*c*, which are not located on the most downstream side in the rotation direction of the intermediate transfer belt B. An opposite power supply circuit Ef', which is an example of a second voltage application unit of the second exemplary embodiment, is connected to the first transfer rollers T1*k*', which is located on the most downstream side. The opposite power supply circuit Ef' includes an AC-voltage-power-supply circuit Efa' and a DC-voltage-power-supply circuit Eck', which is to be used in a first transfer process and which corresponds to the power supply circuit Eck for color K to be used in a first transfer process of the first exemplary embodiment. The opposite power supply circuit Ef' applies a voltage obtained by superposing an AC voltage V3*a*' on a DC voltage V1*k*' to the first transfer roller T1*k*'. The opposite power supply circuit Ef' of the second exemplary embodiment includes a switch SW1, which is an example of a switching element. The switch SW1 is configured to be capable of connecting the DC-voltage-power-supply circuit Eck' to the AC-voltage-power-supply circuit Efa' or to the ground.

(Description of Controller of Second Exemplary Embodiment)

In FIG. 7, a controller C' of the second exemplary embodiment includes a first-transfer-voltage controller C1', which is not located on the most downstream side, instead of the first-transfer-voltage controller C1 of the first exemplary embodiment. In addition, the controller C' of the second exemplary embodiment includes an opposite-voltage controller C3' of the second exemplary embodiment instead of the opposite-voltage controller C3 of the first exemplary embodiment. The first-transfer-voltage controller C1', which is not located on the most downstream side and which is an example of a first power supply controller of the second exemplary embodiment, controls the power supply circuits Ecy to Ecc for use in a first transfer process, which are not located on the most downstream side, in such a manner as to control first transfer voltage V1*y* to V1*k* that are to be applied to the first transfer rollers T1*y* to T1*c*, which are not located on the most downstream side, respectively.

The opposite-voltage controller C3' of the second exemplary embodiment controls the opposite power supply circuit Ef' in such a manner as to control the electric-field-generating member 3', that is, a voltage V3*a*'+V1*k*' that is to be applied to first transfer rollers T1*k*'. In other words, the opposite-voltage controller C3' of the second exemplary embodiment also functions as a first power supply controller, which is located on the most downstream side. In the case of transferring toner images onto embossed paper or Japanese paper, the opposite-voltage controller C3' of the second exemplary embodiment connects the switch SW1 to the AC-voltage-power-supply circuit Efa'. Then, the opposite-voltage controller C3' of the second exemplary embodiment applies the voltage obtained by superposing the AC voltage V3*a*' on the DC voltage V1*k*' to the first transfer roller T1*k*'. In the case of transferring toner images onto normal paper, thin paper, or thick paper, the opposite-voltage controller C3' of the second exemplary embodiment connects the switch SW1 to the ground. Then, the opposite-voltage controller C3' applies only the DC voltage V1*k*' to the first transfer roller T1*k*' without applying the AC voltage V3*a*' to the first transfer roller T1*k*'.

(Operation of Transfer Device of Second Exemplary Embodiment)

In the copying machine U of the second exemplary embodiment, which has the above-described configuration, once the copy start key has been input, the toner-image-forming members UY+GY to UK+GK form toner images of different colors. Here, electric fields corresponding to the first transfer voltage V1*y* to V1*c* are generated in the first transfer regions Q3*y* to Q3*c*, which are not located on the most downstream side. Thus, toner images on the photoconductor drums Py to Pc are sequentially transferred in a first transfer process onto the intermediate transfer belt B. When the toner images of colors Y, M, and C, which have been superposed with one another in this color order, are transported to the first transfer region Q3*k* for color K, the toner image of color K is transferred onto the intermediate transfer belt B by the electric field corresponding to the DC voltage V1*k*'.

Here, in the cases of embossed paper and Japanese paper, the AC voltage V3*a*' is superposed on the DC voltage V1*k*' in the first transfer region Q3*k* for color K of the second exemplary embodiment. Thus, an AC electric field is formed between the photoconductor drum Pk and the first transfer rollers T1*k*', that is, between the photoconductor drum Pk and the intermediate transfer belt B. As a result, the AC electric field acts on the toners on the intermediate transfer belt B when the toners pass through the first transfer region Q3*k* for color K. Consequently, the toner vibrate in the gap H1', that is, the gap region Q11', which is located downstream of the first transfer region Q3*k*. Therefore, similarly to the first exemplary embodiment, in the second exemplary embodiment, an AC electric field is generated in an area in which any one of the sheets S is disposed in such a manner that the adhesion force of toners is reduced before the toners are delivered to the second transfer region Q4. Accordingly, similarly to the first exemplary embodiment, in the second exemplary embodiment, the probability of the occurrence of electric discharge is reduced, and the deterioration of the members included in the transfer device T1+B+T2+CLB is likely to be suppressed. In addition, the occurrence of white spots in an image is suppressed.

In the second exemplary embodiment, the electric-field-generating member 3' is formed of the photoconductor drum Pk and the first transfer rollers T1*k*'. In addition, the drum cleaner CLk is disposed around the periphery of the photoconductor drum Pk, which is a part of the electric-field-generating member 3 and which is positioned on the side on which toners may vibrate. Thus, it is not necessary to provide a cleaner dedicated to the electric-field-generating member 3', such as the opposing cleaner 11 of the first exemplary embodiment. Therefore, in the second exemplary embodiment, the adhesion force of the toners is reduced with a smaller number of components than in the first exemplary embodiment.

(Modifications)

Although the exemplary embodiments of the present invention have been described in detail above, the present invention is not limited to the above-described exemplary embodiments, and various changes may be made within the scope of the present invention as described in the claims. Exemplary modifications (H01) to (H06) of the present invention will be described below.

(H01) Although the copying machine U has been described in the above-described exemplary embodiments as an example of an image forming apparatus, the image forming apparatus is not limited to this, and the present invention may be applied to a printer, a facsimile machine, a multifunction machine that has some of the functions of the printer and the facsimile machine, or the like. In addition, the image forming apparatus is not limited to an image forming apparatus for multicolor development and may be an image forming apparatus that forms monochromatic images, or specifically black-and-white images.

(H02) Although, in the first exemplary embodiment, it is desirable that the gap H1 be formed, a configuration in which the opposing roller 2 and the intermediate transfer belt B are disposed in such a manner as to be in contact with each other, and in which an AC electric field acts on toners by utilizing a wedge-shaped gap that is defined between the opposing roller 2 and the intermediate transfer belt B on the downstream side of an area in which the opposing roller 2 and the intermediate transfer belt B are in contact with each other may be employed.

(H03) Although, in the first exemplary embodiment, it is desirable that the opposing cleaner 11 be provided, the opposing cleaner 11 may be omitted. In addition, the configuration in which the opposing cleaner 11 includes the plate-shaped cleaning blade 13 as an example of a cleaning member has been described as an example, the present invention is not limited to this, and a configuration in which a cleaning brush is provide may be employed. In other words, the opposing cleaner 11 may have a configuration of a cleaning unit that is known in the related art and that cleans photoconductor drums and an intermediate transfer belt.

(H04) Although, in the first exemplary embodiment, the configuration in which the opposing roller 2 has a columnar shape has been described as an example, the opposing roller 2 may be formed in a rectangular column, a plate-like shape, a wire shape, or the like.

(H05) Although, in the exemplary embodiments, it is desirable not to apply the AC voltages V3*a* and V3*a*' in the case of transferring toner images onto normal paper or the like, the present invention is not limited to this, and an AC electric field may be caused to act on toners by applying the AC voltage V3*a* or V3*a*' also in the case of transferring toner images onto normal paper or the like.

(H06) A configuration in which, in the case where a toner image is held on an image carrier, an opposing member is disposed further upstream than an area in which the toner image is transferred onto one of the sheets S, so that an AC electric field acts on the toner image on the image carrier before the toner image is transferred onto the sheet S may be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

at least one image carrier that carries a toner image;

an intermediate transfer body that is rotatable and that faces the image carrier;

an opposing member that is positioned upstream of a second transfer section in a direction of rotation of the intermediate transfer body and that faces the intermediate transfer body; and a voltage application unit that applies an alternating-current voltage, whose polarity reverses, and forms an alternating-current electric field between the intermediate transfer body and the opposing member, wherein a first transfer section in which the toner image on the image carrier is transferred onto a surface of the intermediate transfer body is formed, and wherein the second transfer section that is positioned downstream of the first transfer section in the direction of rotation of the intermediate transfer body and in which the toner image on the intermediate transfer body is transferred onto a medium is formed.

2. The image forming apparatus according to claim 1, further comprising:

a second transfer member that is disposed to face the surface of the intermediate transfer body in the second transfer section; and a second voltage application unit that applies only a direct-current voltage to the second transfer member.

3. The image forming apparatus according to claim 1, wherein the opposing member is disposed downstream of the first transfer section in the direction of rotation of the intermediate transfer body.

4. The image forming apparatus according to claim 1, wherein the opposing member is spaced apart from the surface of the intermediate transfer body with a gap, and wherein the gap is set to about 20 μm or larger and about 200 μm or smaller.

5. The image forming apparatus according to claim 1, further comprising:

a plurality of first transfer members each of which is disposed to face a corresponding one of a plurality of the image carriers with the intermediate transfer body interposed between the first transfer member and the image carrier; and a first voltage application unit that applies only a direct-current voltage to the first transfer members that are disposed upstream of one of the first transfer members that is located on a most downstream side in the direction of rotation of the intermediate transfer body, wherein the plurality of the image carriers are arranged in a row in the direction of rotation of the intermediate transfer body, wherein the opposing member is the first transfer member that is located on the most downstream side in the direction of rotation of the intermediate transfer body, and wherein the voltage application unit is capable of applying the alternating-current voltage on which the direct-current voltage is superposed to the opposing member.

6. The image forming apparatus according to claim 1, wherein the voltage application unit applies the alternating-current voltage when the toner image is transferred onto a medium that is determined as a medium that has a surface on which large projections and depressions are formed or a medium that is determined as a medium that has large variations in electric resistance and does not apply the alternating-current voltage when the toner image is transferred onto a medium that is determined as a medium that has a surface, on which small projections and depressions are formed, and small variations in electric resistance.

* * * * *